US011406891B2

(12) United States Patent
Leal et al.

(10) Patent No.: US 11,406,891 B2
(45) Date of Patent: Aug. 9, 2022

(54) GAME INCLUDING AN AIRBORNE VEHICLE

(71) Applicant: PlayMonster LLC, Beloit, WI (US)

(72) Inventors: Jose Leal, Stow, MA (US); Donald Ullman, Fairfield, CT (US)

(73) Assignee: PlayMonster LLC, Beloit, WI (US)

( * ) Notice: Subject to any disclaimer, the term of this patent is extended or adjusted under 35 U.S.C. 154(b) by 0 days.

(21) Appl. No.: 16/996,287

(22) Filed: Aug. 18, 2020

(65) Prior Publication Data

US 2022/0054933 A1 Feb. 24, 2022

(51) Int. Cl.
*A63F 9/14* (2006.01)
*A63H 27/00* (2006.01)
*A63H 33/20* (2006.01)

(52) U.S. Cl.
CPC ..... *A63F 9/143* (2013.01); *A63H 27/00* (2013.01); *A63H 33/20* (2013.01)

(58) Field of Classification Search
CPC ..... A63F 9/143; A63F 7/00; A63F 7/0023; A63F 7/24; A63F 7/2409; A63F 7/2418; A63F 2007/0029; A63F 2007/0041; A63H 27/00; A63H 33/20; A63H 1/20
USPC ..... 446/36, 37, 57, 58
See application file for complete search history.

(56) References Cited

U.S. PATENT DOCUMENTS 722,603 A * 3/1903 Morgan ..... A63F 7/027 273/118 R
971,626 A 10/1910 Nelson
2,936,546 A 5/1960 Lakin
3,594,000 A * 7/1971 Glass ..... A63F 9/30 273/108
3,619,937 A * 11/1971 Thompson et al. ... A63H 27/00 446/66
3,643,955 A * 2/1972 Breslow ..... A63F 9/02 273/119 R
3,841,629 A * 10/1974 Barlow ..... A63F 9/00 273/440
3,949,519 A * 4/1976 Meyer ..... A63H 27/00 446/61
4,007,933 A * 2/1977 Cooper ..... A63F 7/00 463/69
4,009,879 A 3/1977 Wolf
4,039,188 A * 8/1977 Goldfarb ..... A63F 9/02 273/355
4,061,334 A * 12/1977 Kanno ..... A63F 9/02 273/126 A
4,177,991 A 12/1979 Meyer et al.
4,234,181 A 11/1980 Breslow
4,309,034 A * 1/1982 Matsumoto ..... A63F 9/30 273/357
4,993,983 A * 2/1991 Kurita ..... A63H 17/26 446/130

(Continued)

*Primary Examiner* — Joseph B Baldori
(74) *Attorney, Agent, or Firm* — Fish & Richardson P.C.

(57) ABSTRACT

Among other things, a game includes individual game pieces and an airborne vehicle (having a motor, a battery connected to the motor, a propulsion device connected to the motor, and a game piece support). A controller is configured to activate the motor when a first period of time has passed after one of the individual game pieces has been received at the game piece support and to deactivate the motor when a second period of time has passed after the motor has been activated.

17 Claims, 10 Drawing Sheets

(56) References Cited

U.S. PATENT DOCUMENTS 5,219,433 A * 6/1993 Zaruba ..... A63F 9/18 273/429
5,368,300 A * 11/1994 Becker ..... A63F 7/025 273/119 R
5,389,031 A * 2/1995 Sharpe, III ..... A63H 5/00 446/397
5,403,222 A * 4/1995 Koenig ..... A63H 3/06 446/175
6,520,824 B1 2/2003 Caoselli
6,609,943 B1 * 8/2003 Chan ..... A63H 3/52 446/275
6,991,509 B1 * 1/2006 Carley ..... A63H 5/00 434/334
7,416,466 B2 * 8/2008 Isawa ..... A63H 27/12 446/37
7,780,498 B1 * 8/2010 Caspi ..... A63H 27/02 446/51
8,181,964 B2 * 5/2012 Ritter ..... A63F 9/24 273/445
8,420,923 B1 * 4/2013 Choi ..... G10H 1/32 84/644
D697,145 S 1/2014 Wong
8,757,628 B1 6/2014 Baker
9,011,192 B2 * 4/2015 Canobbio ..... A63H 27/12 446/37
D734,400 S 7/2015 Rehkemper et al.
9,393,499 B1 * 7/2016 Flanagan ..... A63H 3/003
10,268,330 B2 5/2019 Yatsko
10,737,782 B2 * 8/2020 Beltman ..... B64D 47/08
2003/0236112 A1 * 12/2003 Breslow ..... A63F 3/00643 463/9
2005/0061909 A1 * 3/2005 Winston ..... A63H 30/04 244/17.19
2007/0087650 A1 * 4/2007 Ali ..... A63H 3/50 446/137
2016/0059145 A1 * 3/2016 Cortelyou ..... A63J 5/025 472/57
2018/0154270 A1 6/2018 Barrett et al.

* cited by examiner

GAME INCLUDING AN AIRBORNE VEHICLE

BACKGROUND

This description relates to a game including an airborne vehicle (sometimes called a "drone").

SUMMARY

In general, in an aspect, a first game piece associated with a player is received on an airborne vehicle. After receiving the first game piece, one or more other game pieces of the player or of one or more other players are received on the airborne vehicle. The airborne vehicle is automatically launched, with one or more game pieces of the player or the one or more other players that are then situated on the airborne vehicle, at a time after the first game piece has been received.

Implementations can include one or a combination of two or more of the following features. One or more game pieces are discharged from the airborne vehicle before the time when the airborne vehicle is automatically launched. The game pieces are received in a payload bay of the airborne vehicle.

In general, in an aspect, a game includes individual game pieces and an airborne vehicle (having a motor, a battery connected to the motor, a propulsion device connected to the motor, and a game piece support). A controller is configured to activate the motor when a first period of time has passed after one of the individual game pieces has been received at the game piece support.

Implementations may include one or a combination of two or more of the following features. There is circuitry to detect a presence of one of the game pieces on the game piece support and to begin timing the first period of time based on the detection of the presence of the game piece on the game piece support. The first period of time includes a pre-defined period. There are devices that can be controlled by respective players to propel one or more of the game pieces towards the game piece support during the first period. Each of the game pieces has an uneven weight distribution to stabilize it when resting on a bottom surface of the game piece.

In general a game includes a launch pad, game pieces, and a vehicle. A force-imposing mechanism can lift the vehicle from the launch pad. The vehicle has a payload bay and a bottom configured to rest on the launch pad. One or more surfaces provide paths to the launch pad from different locations external to the launch pad. For each of the paths there is a mechanism movable to impart a force toward the launch pad.

Implementations can include one or a combination of two or more of the following features. The vehicle includes a propeller driven airborne vehicle. The game pieces are organized in sets and the game pieces of the different sets have different visible characteristics. The one or more surfaces that provide paths to the launch pad are pitched upward in the direction of the launch pad and are level in the direction normal to the direction of the launch pad.

In general, in an aspect, a game piece includes a round body having a profile of a miniature alien, a top, a bottom, a non-uniform weight distribution that is heavier nearer the bottom, and a ferrous (e.g., steel) ballast on the bottom.

These and other aspects, features, implementations, and advantages (a) can be expressed as methods, apparatus, systems, components, program products, business methods, means or steps for performing functions, and in other ways, and (b) will become apparent from the following description and from the claims.

DESCRIPTION

FIGS. 1, 2, and 3 are perspective, top, and bottom views of a game.

FIGS. 4, 5, 6, and 7 are a perspective exploded view, a perspective assembled view, a perspective assembled view, and a sectional side view of a game piece.

Figure 1:
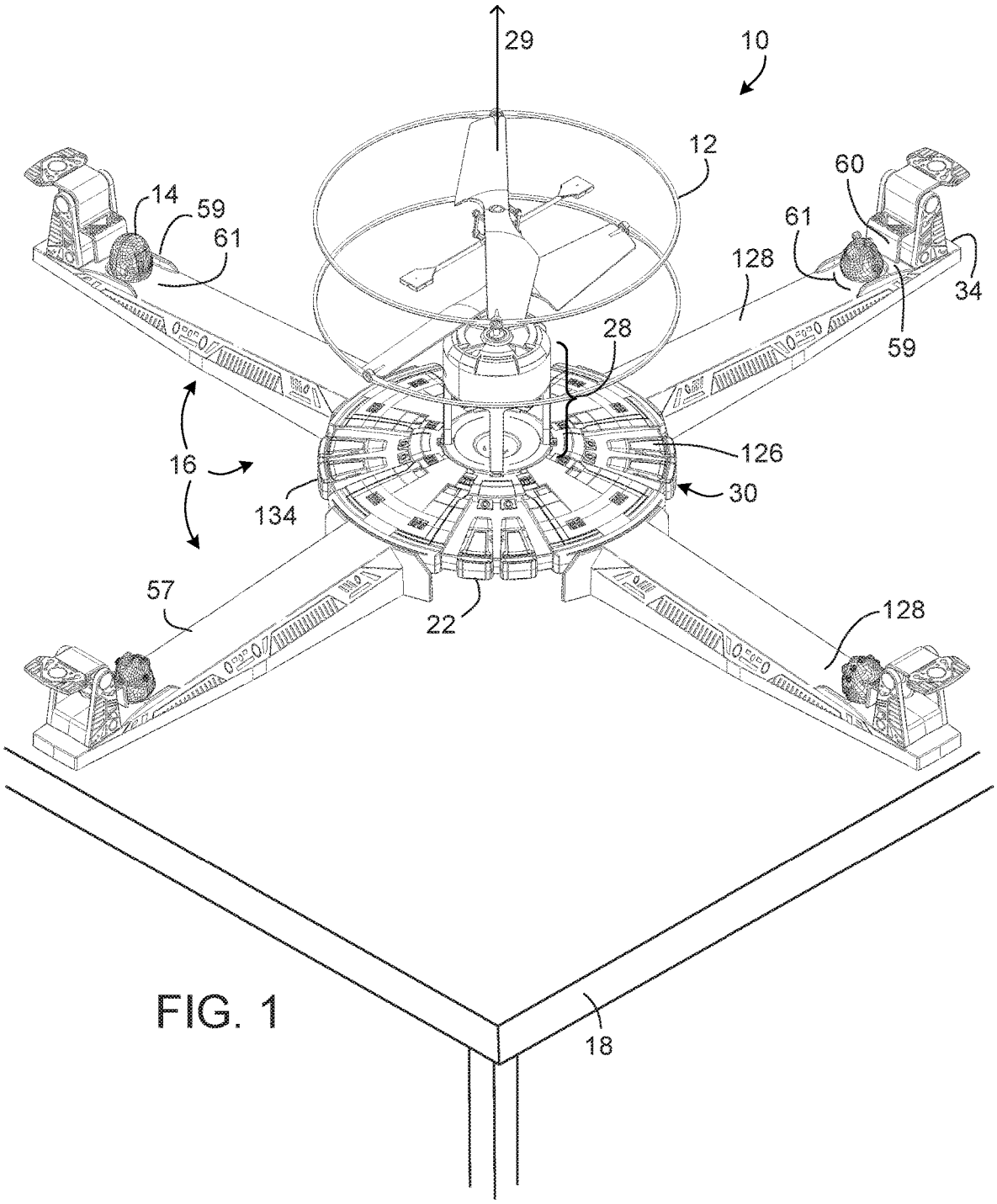
Figure 2:
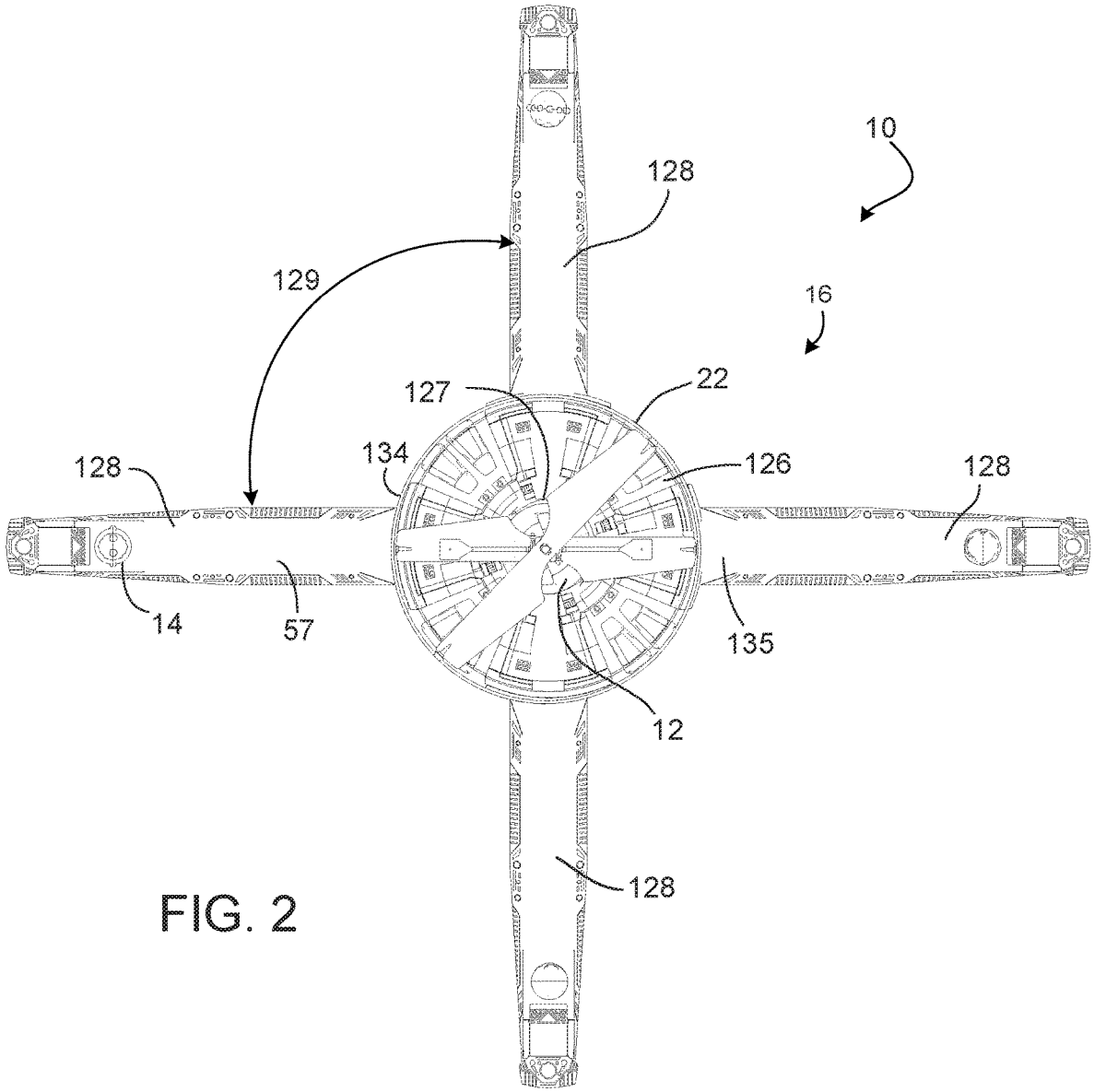
Figure 3:
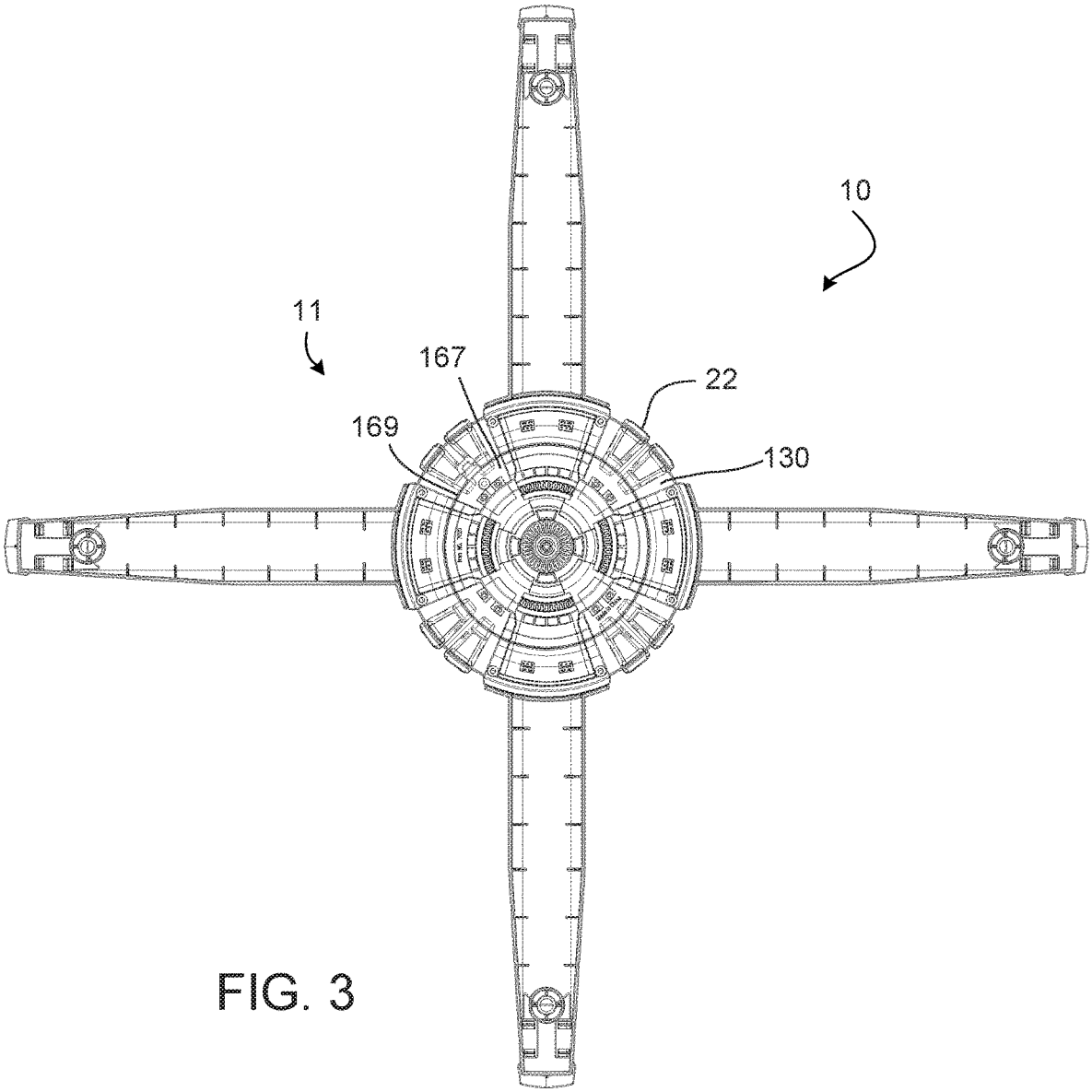
Figure 5:
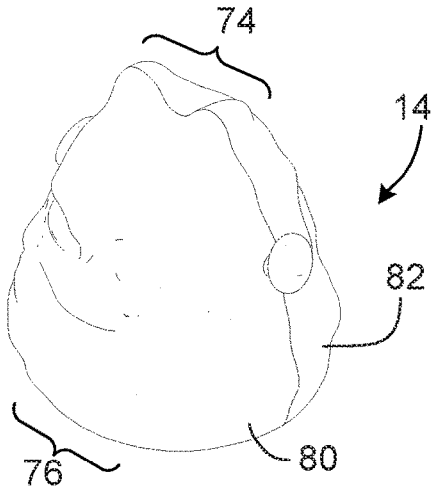
Figure 4:
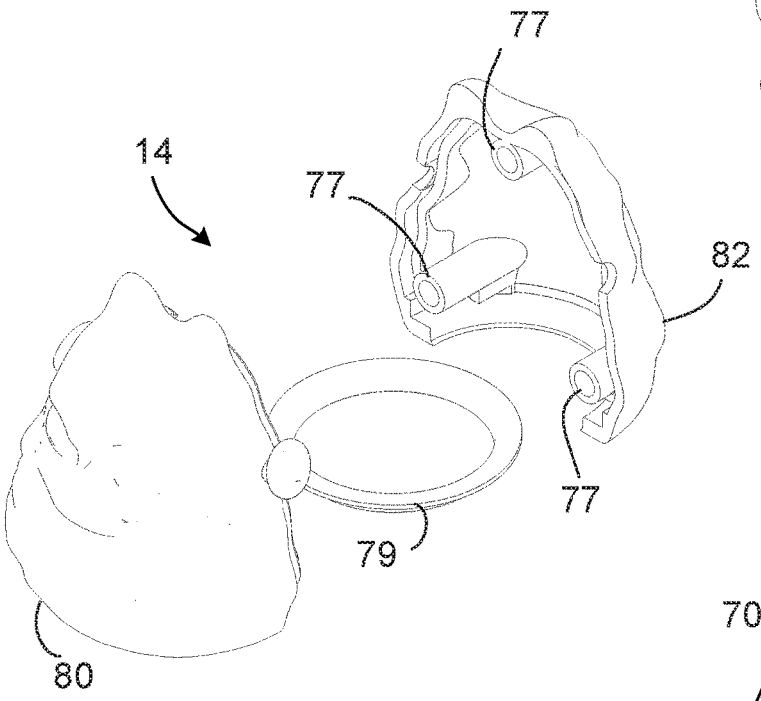
Figure 7:
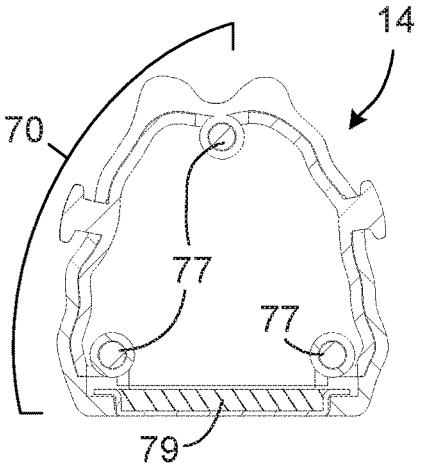
Figure 6:
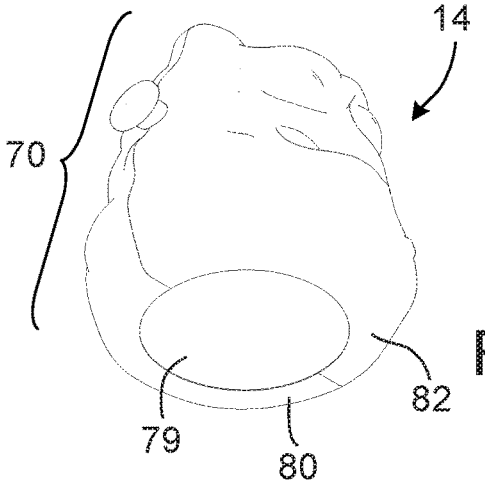

As shown in FIGS. 1, 2, and 3, in some implementations of a game 10, an airborne vehicle 12 (sometimes called "a drone") can be launched to carry one or more game pieces 14 (sometimes called "aliens") into the air and away from a platform structure 16 that rests, for example, on a table 18 between two, three, or four players. The players all begin the game with the same numbers of aliens. The game is played in rounds and is won by the first player to have launched all of his or her aliens on the airborne structure, enabling them to "escape." A game can comprise three rounds, or other numbers of rounds depending on the implementation. In case of a tie, only the players who have tied will compete in a tie-breaker round in which the first player to launch an alien wins.

We use the term "airborne vehicle" broadly to include, for example, any device that can be launched or propelled into the air from a non-airborne position on a static support. An airborne vehicle can be self-launched or self-propelled by an onboard propulsion device (for example, a motor driven propeller) or launched or propelled by an external force applied from or at the static support.

Played in Rounds

When a round of the game begins (as signaled by the players calling out "three, two, one," for example), the airborne vehicle is at rest on a launch pad 22 of the platform structure 16 ready for launch. Before the airborne vehicle is launched, each player tries to load one or more of his or her aliens into a payload bay 28 of the airborne vehicle. The players are not permitted to do this simply by placing aliens into the payload bay by hand. Instead, each player must propel his or her aliens, one at a time, along a launch ramp 26 toward and (if the player is successful) into the payload bay 28.

We use the term "payload bay" broadly to include, for example, any space, structure, receptacle, cage, or other place on an airborne vehicle in which an object or material can be temporarily held during flight.

Each round can be considered to extend for two successive periods: a "race period" followed by a "flight period". Each round ends when the airborne vehicle has completed its flight period and falls to the ground.

Race Period

The race period starts at the beginning of the round and ends with the beginning of the flight period. The race period includes two successive sub-periods: the "pre-load" sub-period and the "pre-flight" sub-period. The pre-load sub-period begins at the beginning of the race period and ends when any alien is first propelled into the payload bay and becomes seated in the center of the payload bay triggering the optical trigger described later.

Pre-Load Sub-Period

During the pre-load sub-period, the players compete and race to be the first to successfully propel an alien into the payload bay and have the alien seated in the center of the payload bay. The duration of the pre-load sub-period is indefinite and can continue as long as no alien has become seated. Once an alien is seated and the switch is triggered, the pre-flight sub-period begins.

Pre-Flight Sub-Period

The pre-flight sub-period begins when an alien of any one of the players has been successfully propelled into and is successfully seated in the center of the payload bay. During the pre-flight sub-period, the airborne vehicle remains at rest on the launch pad ready to receive other aliens in the payload bay and to be launched at the end of the pre-flight sub-period. Until the end of the pre-flight sub-period, each player may be able to propel one or more aliens into the bay, and one or more aliens may be knocked out of the bay including an alien that has been seated. As a result, the number of aliens in the payload bay, whether any of the aliens is seated, and the players to whom the aliens in the payload bay belong can change one or more times during the pre-flight sub-period. The players may need to move around the platform structure during the pre-flight sub-period to fetch their aliens that were not successfully propelled into the payload bay or that were knocked out of the payload bay by another player's alien. In some examples of the game, the pre-flight sub-period may begin when any player successfully propels an alien into the payload bay and the alien is seated in the center of the payload bay. The pre-flight sub-period then can last 4 seconds, or another period in a range from 2 seconds to 10 seconds. At the end of the pre-flight sub-period, the airborne vehicle is launched. If the end of the pre-flight sub-period is reached with no alien seated in the payload bay (as a result of a player's defensive move, for example), the flight can be aborted.

We use the term "round" broadly to include, for example, a time period during which players compete to have their game pieces occupy the payload bay and remain there for launch in order to score a point. A pre-flight sub-period can be a fixed predetermined amount of time or a time period determined dynamically based on a variety of factors including the number of game pieces on the airborne vehicle at one or more times, the history of launches of the airborne vehicle, the number of rounds of the game already completed, the number of players, and others, and combinations of them. In some instances, the end of the pre-flight sub-period may not be predetermined.

When the players see that one or more aliens are in the bay and one of them is seated they will recognize that only a limited pre-flight sub-period (for example, a small number of seconds) remains until the vehicle is launched. During the pre-flight sub-period, each player (either a player who has one or more aliens in the bay or a player who has no aliens in the bay) can engage in one or both of the following actions: (1) propel one or more of their own aliens up the ramp and into the bay so that one or more of their aliens are launched in the vehicle; and (2) propel one or more of their aliens up the ramp and into the bay to knock one or more aliens of another player out of the bay to reduce the number of competitor player's aliens that are launched.

During a given round and in successive rounds, each player can propel one alien after another toward the payload bay for possible launching on the airborne vehicle. As a player's aliens are launched, the player has fewer aliens left and is therefore unable to take as many actions to propel aliens into the bay as other players who have more unlaunched aliens. In other words, the game becomes relatively more challenging for players as they succeed in launching more of their aliens. For example, such players may find it necessary to "chase down" their aliens who are the subject of missed shots more frequently than players having more aliens.

At the end of the pre-flight sub-period, the airborne vehicle is launched 29 automatically on a brief flight. In some implementations of the game, the powered period of the flight may last 3 to 4 seconds or some other period between 2 seconds and 10 seconds. At the end of the powered period of the flight, the motor of the airborne vehicle is turned off and the airborne vehicle free falls to the ground. In some implementations a more controlled landing mechanism (such as a controlled descent or a parachute) may be envisioned.

After the flight, the launched aliens are removed from the bay or gathered from the ground (in the event that they fell from the bay upon landing) and can no longer be used in the game. The "owner" of each alien that has been successfully launched gets a point for that alien. The airborne vehicle is then put back in its resting position on the launch pad, ending one round of play. Subsequent such rounds are played one after another until the game is won (for example, after three points are accumulated by any one player). Because the payload bay of the vehicle can accommodate a finite number of aliens (for example, three), the game requires more than one round (that is, requires launching the airborne vehicle more than once) for any player to win. Although there is space in the payload bay theoretically to hold three aliens, in practice, only two can be successfully launched as any third alien tends to fall off the airborne vehicle at the time of launch. Therefore, at a minimum, two rounds of play are required in order for any player to win the game. In practice, however, more rounds are typically played before the game is won.

Aliens

The game includes four sets of individual game pieces that represent the aliens. Each player "owns" all of the aliens of one of the sets during a given game. The four sets all have the same numbers of aliens, for example, 3 aliens per set for a player or some other number in the range of 2 to 6 aliens per set. The aliens of each set can be distinguished from aliens of other sets, for example, based on their different colors or other visible characteristics, so that the players can differentiate the aliens of the different sets quickly and easily. The aliens within each set can have identical appearances other than, for example, their color. In typical examples, all of the aliens of all of the sets have the same or similar size, shape, configuration, weight, and weight distribution. However, the different sets of aliens can have somewhat different surface features that distinguish their facial and other characteristics and impart to each set a unique appearance or character.

As shown in FIGS. 4, 5, 6, and 7 in some examples, each alien 14 is generally round and has a surface contour 70. The surface contour 70 imparts to the game piece a fantasy appearance of what may be considered an alien. Each alien is formed from two half-shells 80 and 82 aligned at three location points 77 and attached to one another using a sonic weld with a ferrous (e.g., steel) ballast 79 captured in between, thereby forming the bottom as shown.

Alien Pusher

Figure 8:
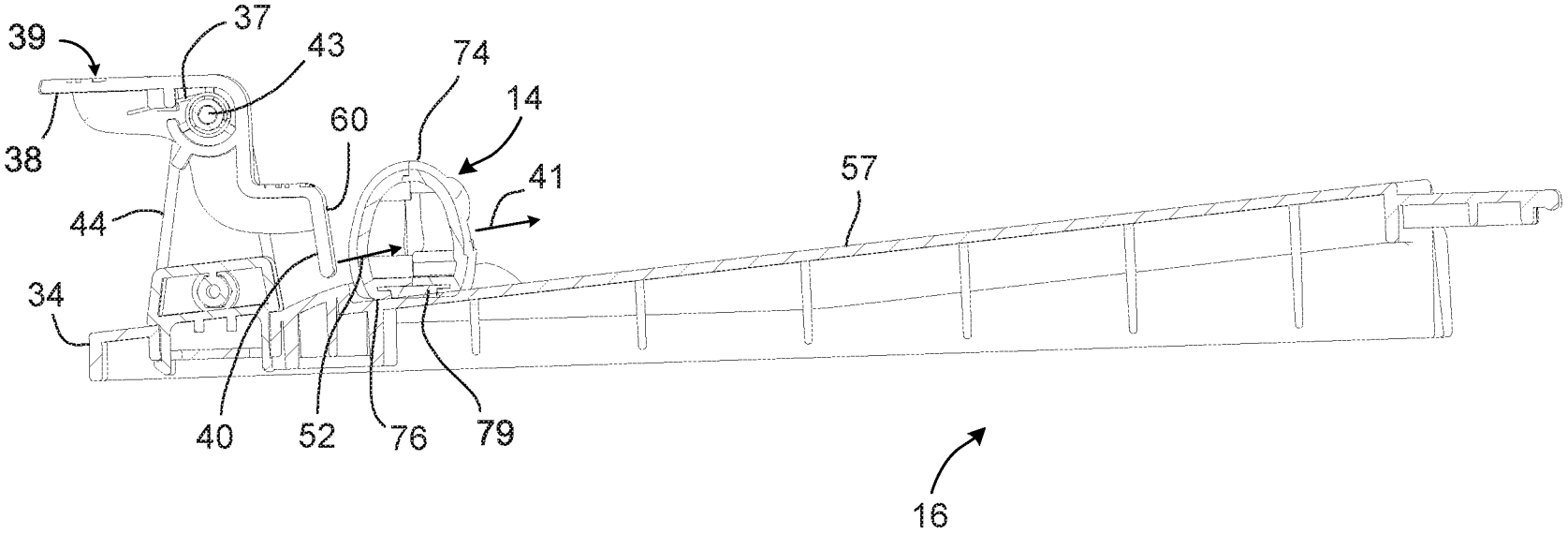
FIG. 8 is a sectional side view of a game piece and a propelling mechanism.
Figure 9:
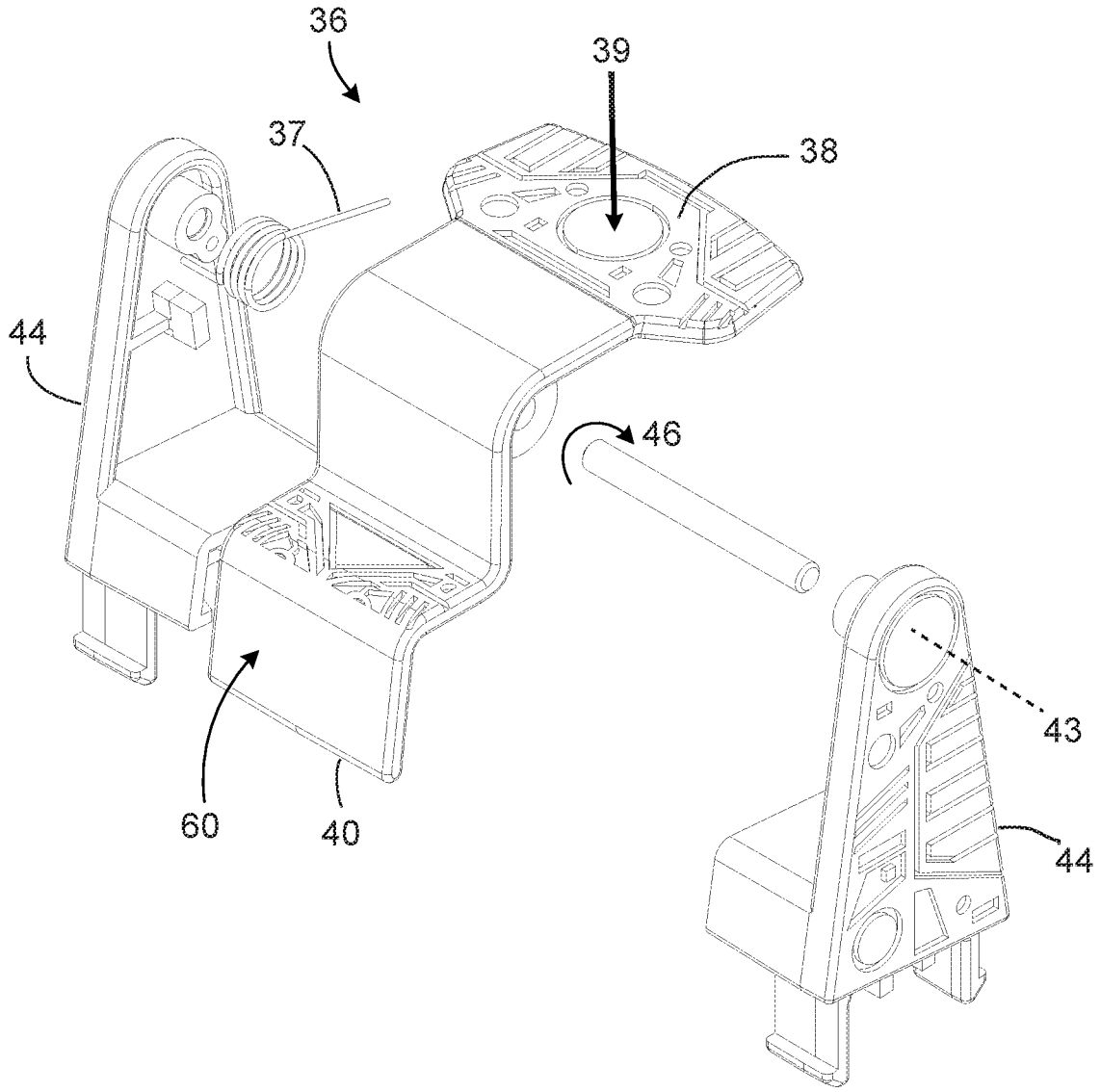
FIG. 9 is a perspective exploded view of a propelling mechanism.

As shown also in FIGS. 8 and 9, the distribution of weight from the top 74 to the bottom 76 of the alien and the surface contour 70 can be designed to work effectively with a surface 60 of a pusher 40 and a configuration of a touch bar 38 (also called a "paddle") associated with each player's launch ramp so that when the touch bar 38 is pushed down 39 with an appropriate force and at an appropriate speed the alien is pushed 41 along a surface 57 of the launch ramp toward (and with enough speed to reach) the payload bay. Among other things, the alien can be weighted more heavily toward its bottom 79 to increase its stability and reduce the degree to which the alien may lift off the launch ramp when propelled toward the payload bay. However, the surface contour and weight distribution are also designed to permit the alien to lift off the launch ramp in some circumstances, depending on the speed and force with which the player presses on the touch bar. If the alien lifts off the launch ramp, the likelihood that it will fall off the ramp and not reach the payload bay increases, making the game more challenging. In some examples of the game, the alien has a uniform contour around its body, and the user can place it next to the pusher facing in any direction without changing the way the alien will respond to a given pressing of the touch bar. In some cases, the alien has external features that project from its surface at locations and with configurations that interact with the surface of the pusher and affect how the alien is propelled when the touch bar is pushed down. The external features of aliens of a given set may have external features that vary around the exterior surface of each alien so that the orientation of the alien when placed next to the pusher surface can affect the direction and speed of the alien when it is propelled. The aliens of the different sets can have different external features so that the behavior of the aliens of different sets, when propelled, will differ.

During game play, each player is positioned near an outer end 34 of one of the launch ramps 16. A lever 36 (sometimes called a "paddle") mounted at the outer end of the launch ramp includes the horizontal touch bar 38 connected to the pusher 40. The lever is mounted at a pivot axis 43 of a support 44 (shown in FIGS. 8 and 9) so that the lever rotates 46 from a resting position to a pushing position relative to the support and the launch ramp when the touch bar 38 is pressed down. As a result, the pusher can apply a force 52 against a game piece placed in contact with, or near to the surface of the pusher and in the direction of the launch pad and payload bay. A torsion spring 37 is coupled between the lever and the support so that when the lever rotates to the pushing position, energy is stored in the spring. Then, when the pressure on the touch bar is released by the player, the spring forces the lever to rotate back to the resting position. This arrangement allows for quick and easy repeated cycling of the lever by a player between the resting position and the pushing position.

The top of each launch ramp includes a u-shaped wall 59 defining a starting area 61. The player can place the alien anywhere within the starting area, which can include positions closer to (but not touching) or farther from the pusher and centered or not centered transversely on the upper surface of the launch ramp. When an alien is placed in a position in the starting area near the exposed surface 60 of the pusher and the player located at the launch ramp of that pusher presses down on the horizontal touch bar, the pusher applies a force against the alien to cause the alien to move along and up the launch ramp in the direction of the launch pad. The launch ramp surface is angled upward from its outer end in the direction toward the launch pad. In the direction normal to the direction between the pusher and the launch pad, the surface of the launch ramp is flat. The speed with which the alien moves and the distance the alien travels before stopping depends on the speed and force with which the player presses down on the horizontal touch bar, the distance between the alien and the pusher surface before the touch surface is pressed, the location of the alien in the starting area relative to the pusher surface before the touch surface is pressed, and the rotational orientation of the alien relative to the external features on its surface. Once the alien starts to travel toward the launch pad and no longer touches or is near to the pusher, the player can no longer control how the alien moves.

Normally if an alien is placed carefully in position and orientation in the space 61, if the platform structure is on a level surface, and if the player presses on the touch bar with enough force and speed, the alien will move in a straight line up the launch ramp and may reach and enter the payload bay.

If the alien is not placed carefully in position and orientation in the space 61, or the player does not press hard enough or fast enough on the touch bar, the alien may move along the launch ramp but not reach the payload bay, or may not move along the entire length of the launch ramp but instead fall off one side, or may reach the payload bay, be propelled through it, and end up on the other side of the platform structure from the player. Then if the player wants to continue game play using that alien, the alien must be fetched and placed again in position in the space 61. Such mishaps put the player at a disadvantage. With respect to being propelled through the payload bay, note that the magnetic attraction on the ballast discussed below is designed to be able to slow the alien as it passes across the payload bay. If the speed of the alien is less than a threshold, the magnetic attraction will be able to stop the alien and cause it to be seated in the center of the payload bay, ready for launch.

Among the skill-based challenges of game play for each of the players are at least one or more of the following: 1. the position of each alien relative to and its distance from the pusher surface when placed in preparation for its being propelled; 2. the orientation of the alien when placed in preparation for its being propelled; 3. the force and speed applied to the touch bar to propel the alien; 4. The delay between a player propelling one of their aliens and the player propelling the next one of their aliens; 5. The player's speed in retrieving an alien that has failed to occupy the payload bay; and 6. The timing of the player pressing the touch bar relative to the timing of other players pressing their touch bars.

Launch Pad and Launch Ramps

As shown in FIGS. 1, 2, 3, and 12, the launch pad 22 of the platform structure is cylindrical and has an upper surface 126 and a bottom surface 130. The launch ramps 128 (e.g., four launch ramps) of the platform structure are arranged at equal intervals 129 around the perimeter surface 134 of the launch pad. The perimeter surface 134 includes four friction-fit couplers (not shown) to receive the inner ends 135 of the four launch ramps. The launch ramps can be attached and detached repeatedly to and from the launch pad for storage (and for purposes of original store packaging) in order to set up the game for game play.

Each launch ramp has a flat upper surface 57 that is angled gradually upward from the support 44 to the inner end 135. The angle of the rise is slightly less than the angle of rise of an upper outer annular surface 126 of the launch pad. The angle of rise of the ramp (for example, 4.7 degrees, or another angle in the range of 3 degrees to 6 degrees) is chosen so that the inner edge 127 of the surface 126 reaches the level of the floor of the payload bay and helps to direct propelled aliens into the payload bay.

Figure 12:
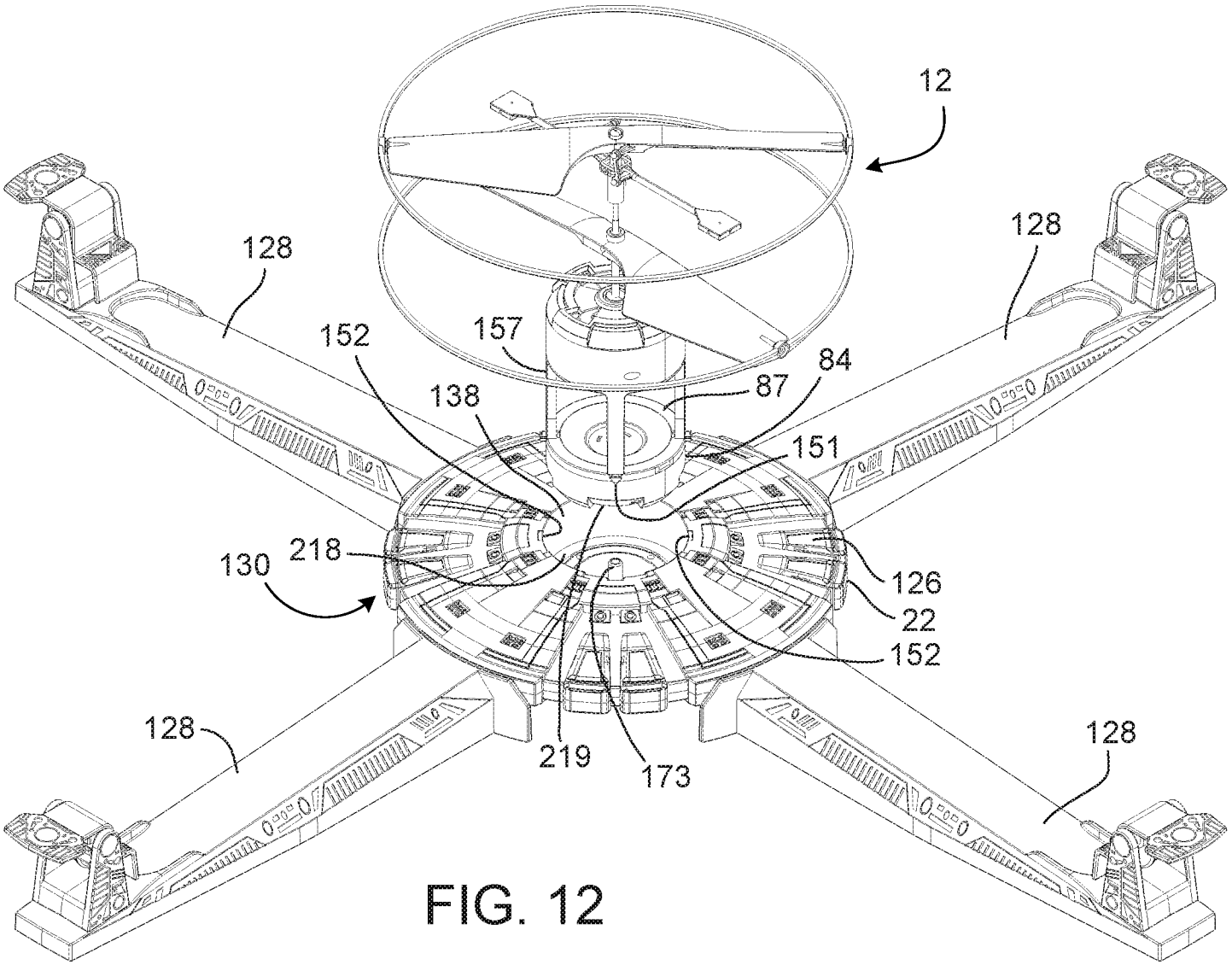
FIG. 12 is an isometric view of an airborne vehicle and a launch pad.

As shown also in FIG. 12, a round central socket 138 on the upper surface of the launch pad is sized and shaped to receive a base assembly 84 of the airborne vehicle so that an upper outermost surface of the base assembly (that is, the floor of the payload bay 87) is in the same plane as the inner rim of the launch pad surface 126, when the airborne vehicle is resting before launch. The exterior of the base assembly of the airborne vehicle and the inner wall of the central socket 138 of the launch pad have mating features 151, 153 (for example chamfered recesses on the inner wall of the central socket and corresponding nibs on the exterior of the base assembly) designed to require that, when the airborne vehicle is placed onto the platform structure ready for launch, the orientation of the airborne vehicle relative to the platform structure orients openings that are between, for example, adjacent pillars 157, 159 in line with the lengths of the launch ramps. As a result, when a player propels an alien along the direction of the launch pad, the payload bay of the airborne vehicle can be entered by the alien. The mating features may take a variety of forms such as chamfers, slots, or other features or combinations of them.

As shown in FIG. 3, the bottom of the launch pad has a removable battery door 167 under which four AAA batteries (not shown) can be installed in a battery compartment 169. In some implementations, the AAA batteries provide an interim, non-corded, charging mechanism during play as explained below.

Airborne Vehicle

Figure 10:
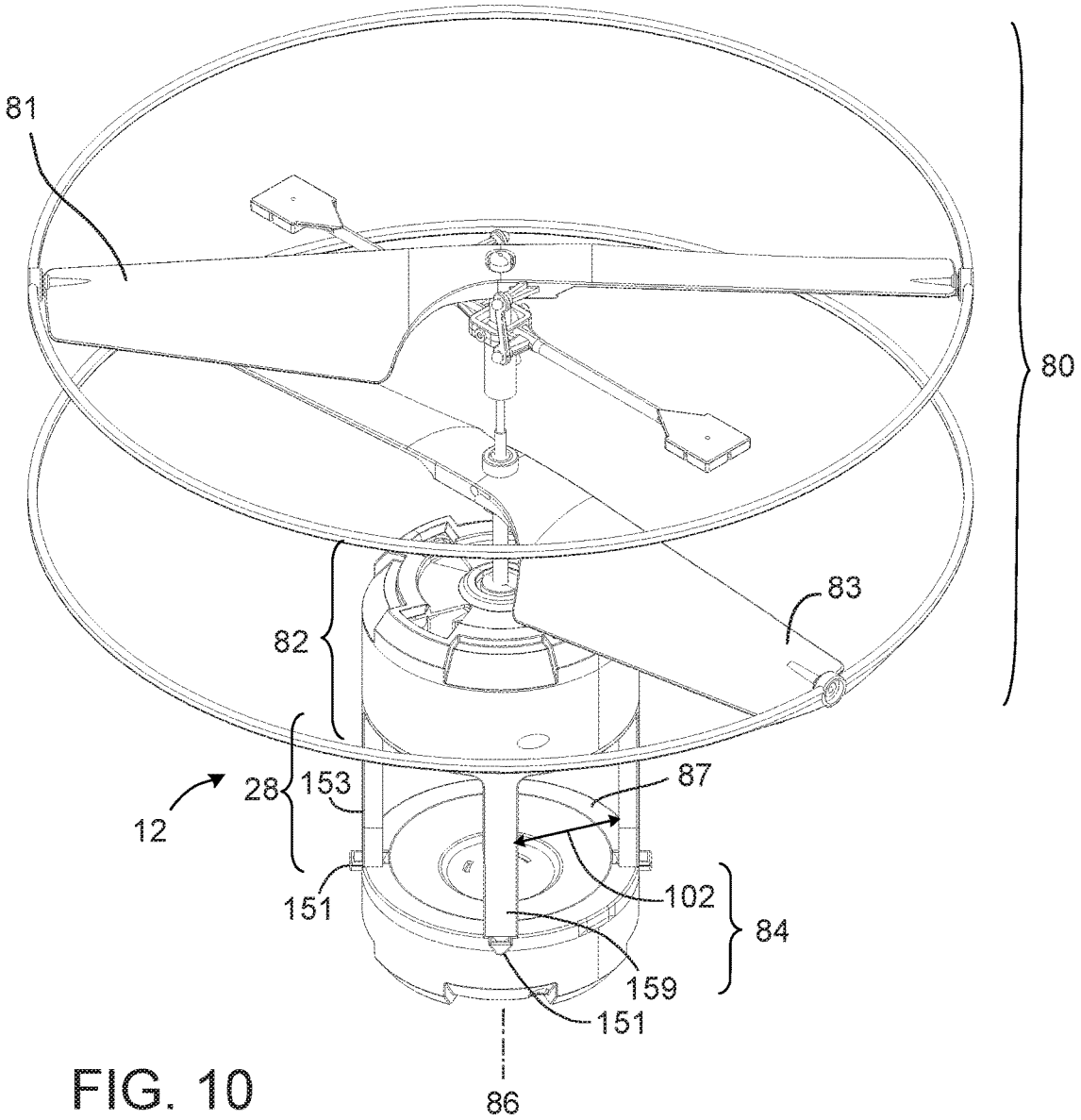
FIGS. 10 and 11 are an isometric view and an isometric exploded view of an airborne vehicle.
Figure 11:
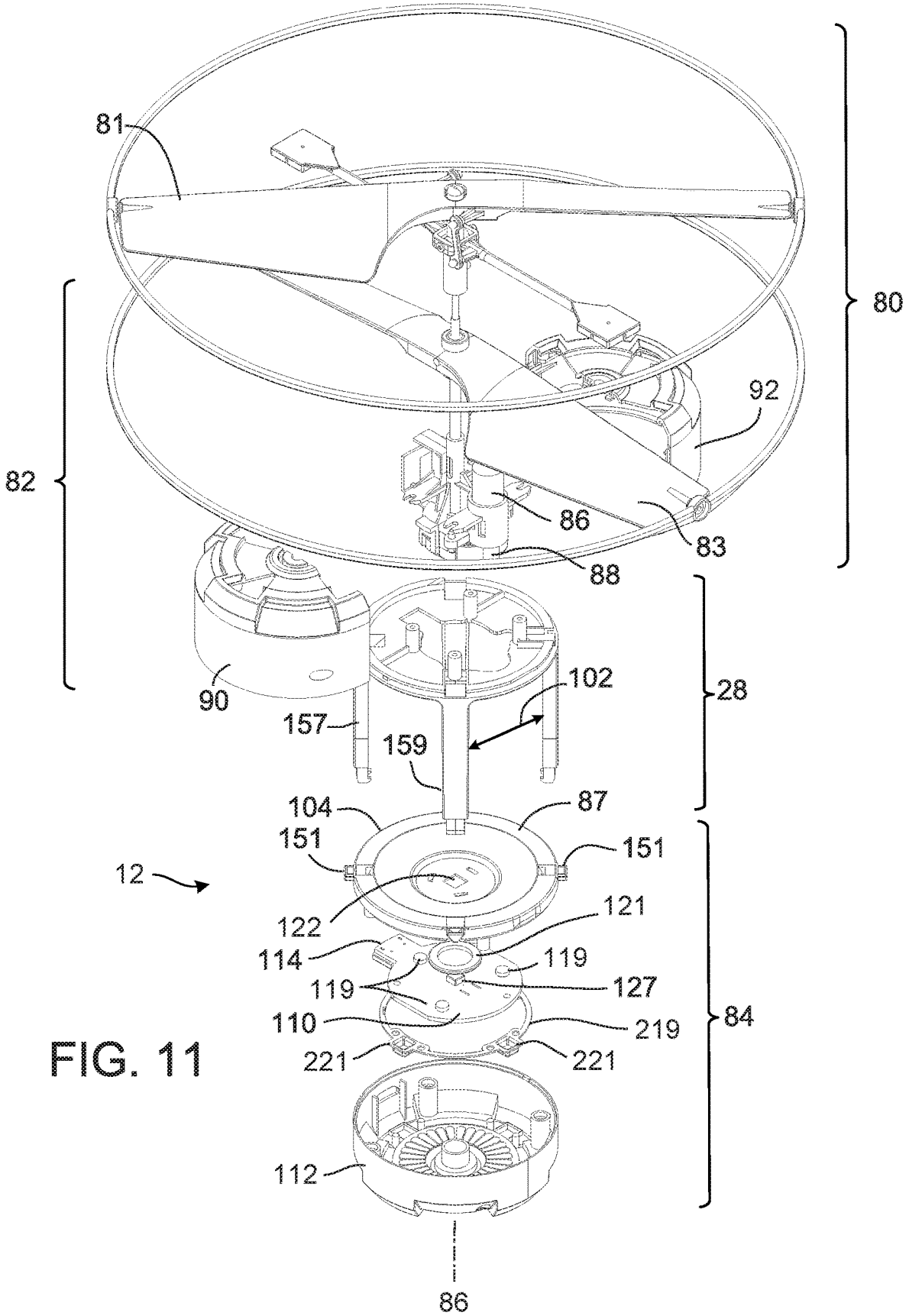

As shown in FIGS. 10 and 11, in some implementations, the airborne vehicle 12 is round and includes a round propeller assembly 80, a round drivetrain assembly 82 attached to the propeller assembly, a round base assembly 84 attached to the drivetrain assembly, and the payload bay 28 for game pieces between the drivetrain assembly and the base assembly. The propeller assembly, the drivetrain assembly, the payload bay, and the base assembly are all aligned on a common axis 86.

Propeller and Drivetrain Assemblies

The propeller assembly can include two propellers 81, 83 spaced apart along the common axis. The two propellers are respectively coupled to the drivetrain assembly 82. The drivetrain assembly includes, in some implementations, a motor 86, a gearbox 88, and external housing components 90, 92. The drivetrain causes the propellers to rotate in opposite directions for stable flight. Each of the propellers can include airfoil blades the tips of which support a circular protective ring to prevent players from being hurt by the propeller tips.

Payload Bay

The payload bay 28 is defined by the cylindrical space between the bottom of the drivetrain assembly 82 and the top surface of a base assembly 84. The payload bay includes, in some implementations, four vertical pillars, previously described. The pillars are arranged at equal intervals around the common axis and each of the pillars extends between the drivetrain assembly and the base assembly. The gap 102 between each adjacent pair of the pillars is wide enough to permit an alien to pass into the bay and rest on the cover 104 of the base assembly ready for launch. The payload bay is high enough to accommodate an alien's height. And the diameter of the cover is broad enough to accommodate three aliens prior to launch but typically only two aliens immediately after the vehicle is launched, because one of the aliens will typically fall out of the payload bay.

Base Assembly

The base assembly 84 has a housing that includes the cover 104 and a bottom shell 112 that are joined by four screws. A circuit board 110 is mounted in the bottom shell 112. A ring-shaped magnet 121 is mounted at the center of the cover of the base assembly, and a square hole 122 is formed at the center of the cover to allow light to pass into the housing and strike an optical trigger, discussed later, when a game piece is not covering the hole.

As discussed earlier, a corresponding ferrous ballast 79 is embedded at the center of the bottom of each alien. When the alien is propelled into the payload bay, the ferrous ballast in an alien may be attracted to the ring-shaped magnet 121. The effect of the attraction can be to slow (and perhaps stop) the alien if it is moving across the upper surface of the cover. The effect of the attraction is to catch and hold in place an alien that enters the payload pay and is moving across the payload bay at a velocity that is not higher than a threshold level. The attraction of the ferrous ballast to the ring-shaped magnet also can serve to hold the alien stably in place at the center of the cover while awaiting launch and during the subsequent flight. We sometimes refer to an alien that is being held stably at the center of the payload bay as being "seated".

Located at the center of a circuit board 110 is an optical trigger 127 facing the hole 122 in the cover. The optical trigger can implicitly detect when an alien is stably held in place (seated) by the attraction of the ferrous ballast to the ring-shaped magnet because in that state the alien obstructs the passage of light from the environment to the optical trigger. Multicolor LED lamps 119 serve to signal the state of the battery (for example, they may illuminate if the battery is charging or, in some implementations if the battery is low) and are also used to create visual effects in multiple colors (such as, in some implementations, strobing or rotational animation) during flight or at other times.

A USB port 114 is mounted on the side wall of the base assembly housing and is accessible to receive a USB plug when the airborne vehicle is not resting in place on the launch pad.

A microprocessor mounted in the base assembly controls the operation and features of the airborne vehicle motors by executing instructions in the form of stored software, firmware, or software implemented as hardware, or a combination of them.

Power Arrangements

The motor and the circuitry of the airborne vehicle are powered by a DC voltage source in the form of a 3.7-volt lithium ion polymer (LiPo) rechargeable battery in the motor assembly. The LiPo battery can be recharged from the four AAA batteries in the launch pad, which are connected in series to form a six-volt power source.

As shown in FIG. 12, for recharging purposes, one electrical end of the six-volt power source is connected to a top electrical contact 173 of a central pin projecting 171 upward from a top surface of the battery compartment. The other electrical end of the six-volt power source is connected to a metal ring 218 exposed at the top surface of the battery compartment. When the airborne vehicle is in place on the launch pad awaiting launch, a central electrical contact 219 and four outer electrical contacts 221 make contact respectively with the electrical contact 173 and the metal ring 218 to recharge the LiPo.

The LiPo battery also can be recharged from an external source (such as a charger) through the USB port on the base assembly when the airborne vehicle is not in place on the launch pad.

The electrical contacts and ring 173, 218, 219, and 221 also serve another function, which is to enable the microprocessor to determine that the airborne vehicle is in place and ready to be launched and sets up the airborne vehicle to begin the pre-flight sub-period once an alien is seated in the payload bay. For this purpose, the microprocessor watches for the presence of a six-volt source across the contact pads. If the six-volt source is found, the microprocessor can close a switch circuit to place the airborne vehicle in a "ready-to-launch" state and to activate the optical trigger 127 to begin detecting the presence of an alien seated in the payload bay.

Microprocessor

Figure 13:
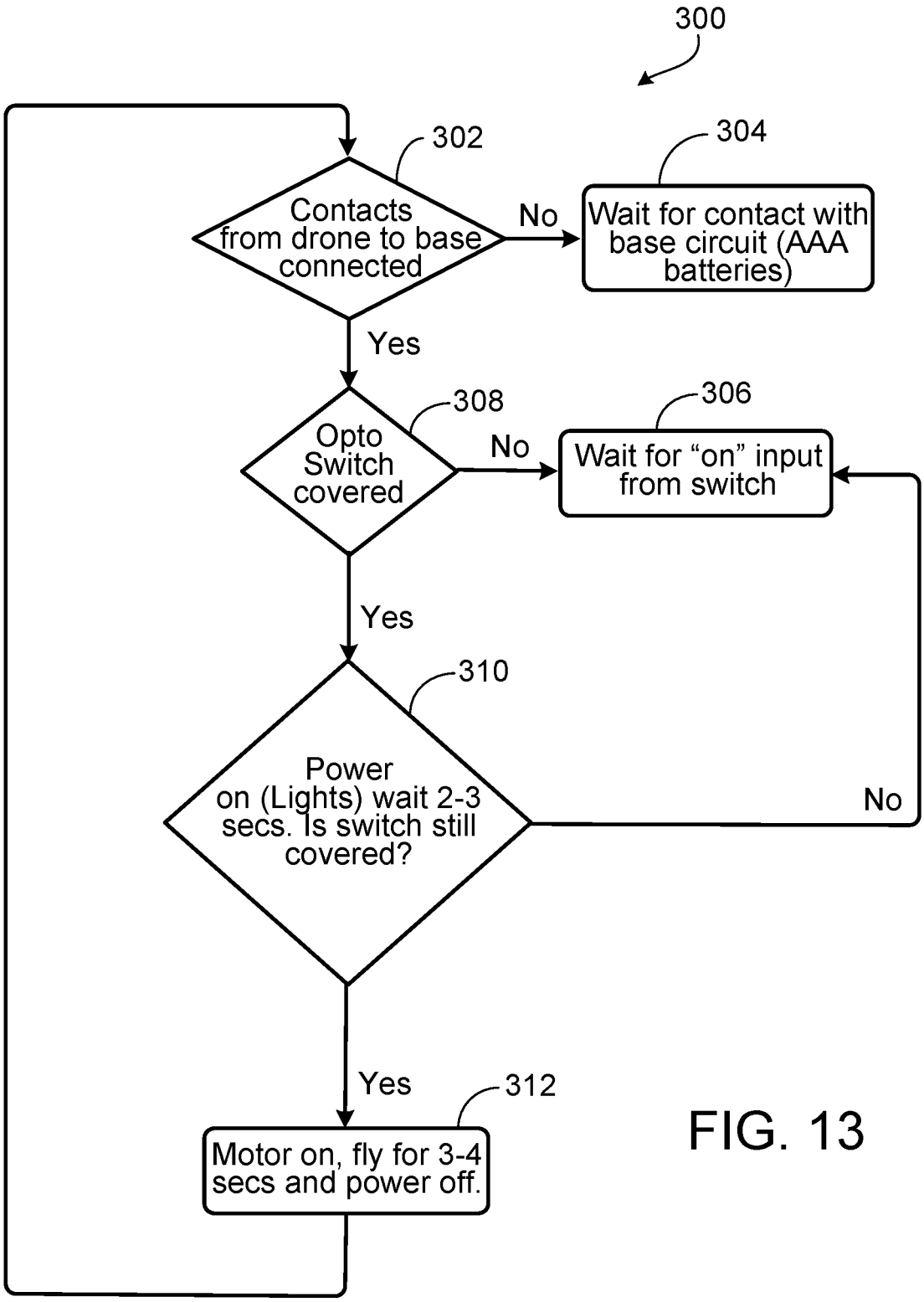
FIG. 13 is a schematic diagram of a software process flow.

The instructions executed by the microprocessor effect a control program represented by the flow chart 300 shown in FIG. 13. The process continually checks 302 for whether the electrical contacts on the bottom of the airborne vehicle are touching the electrical contacts on the launch pad based on the appearance of a voltage across the contacts of the airborne vehicle. Until the voltage appears, the process is "waiting" 304. Once the voltage appears, the process begins watching 308, 306 for the optical trigger to detect the seating of an alien based on the alien obstructing the path for light to the optical trigger. When the optical trigger detects the alien, the process powers on the lights 310 to alert players that the race period has begun, waits a short period (2 to 3 seconds, for example), and checks whether an alien is still seated. If not the process continues to wait 306 until the optical trigger detects a seated alien. If the optical trigger continues to detect a seated alien as of the end of the pre-flight sub-period, the process turns on the motor to begin the flight, keeps it turned on during the flight period, and then turns the motor off 312 and returns to the step of watching for the airborne vehicle to be placed on the launch pad.

Formal Game Rules

In some implementations, the formal rules of the game may be stated as follows:

Set Up

1. Attach the Launch Ramps to the Launch Pad. Ensure that batteries are installed in the Launch Pad.

2. Make sure the Drone is charged and properly seated on the Launch Pad. A red LED illuminates.

3. Have each player choose which color Aliens to use, gather those three aliens and place them near the end of the Launch Ramp of the matching color.

4. Each player may then place one of their Aliens in front of the launch lever at the end of their respective Launch Ramp and practice hitting the lever to launch an Alien down the ramp.

Play

1. Each player should place one Alien in front of their launch lever, with their finger ready to strike the lever!

2. Everyone count down "3 . . . 2 . . . 1 . . . DRONE HOME!" and then start racing!

3. All players are trying at once to land their Aliens inside the Drone so they can fly away!

4. Once an Alien lands inside the Drone and is seated, there is a short pause before the Drone liftoff. As such, there is time to launch your Alien down to knock out another Alien and maybe take its place!

5. If the Drone flies away with an Alien, that Alien is now out and that player is closer to winning! Note: The Drone can launch with more than one Alien inside, and it counts for each player whose Alien flies away!

6. Once the Drone launches and gets at least a foot away from the Launch Pad, the Alien(s) is considered out!

7. Any Aliens who fly away with the Drone are placed out of play. Toss them in the game box or set them off to the side—you can no longer play with them. This makes it a bit trickier to play because you have fewer Aliens to race, the closer you get to winning!

8. As you play, you're going to have to get up and gather your Aliens that perhaps ran off the table or onto the floor . . . and that's part of the fun!

Winning the Game

1. The first player to get all of their Aliens to liftoff with the Drone wins!

2. If there's a tie . . . play a liftoff tie-breaker with winning players racing to see who can launch an Alien first and declare victory!

Other implementations are also within the scope of the following claims.

For example, there can be more or fewer than four launch ramps arranged radially around the launch pad, the propulsion system for the airborne vehicle can be other than motor drive propellers, the upper surfaces of the launch ramps can have a variety of contours other than simple flat and angled upward. Other control processes can be used including more complex determination of the pre-flight period. Other devices can be used to detect the presence of an alien in the payload bay. In some cases, the game can be themed differently than as the escape of aliens using a drone. In such cases, the aliens can be other types of characters, the launch ramps and launch pad can be other types of support platforms. And the airborne vehicle can be other than a drone.

The invention claimed is:

1. A game comprising an airborne vehicle having a motor, a battery connected to the motor, a propulsion device connected to the motor, a payload bay, and an optical sensor directed at the payload bay, individual game pieces, and a controller configured to activate the motor when a first period of time has passed after the optical sensor detects one of the individual game pieces in the payload bay.

2. The game of claim 1 in which each of the game pieces has an uneven weight distribution to stabilize it when resting on a bottom surface of the game piece.

3. The game of claim 1 comprising circuitry to detect a presence of one of the game pieces in the payload bay and to begin timing the first period of time based on the detection of the presence of the game piece.

4. The game of claim 1 in which the first period of time comprises a pre-defined period.

5. The game of claim 1 comprising devices to be controlled by respective players to propel one or more of the game pieces towards the payload bay during the first period.

6. A game comprising a launch pad, a vehicle having a payload bay, a bottom configured to rest on the launch pad, an optical sensor directed at the payload bay, a force imposing mechanism to lift the airborne vehicle from the launch pad, and a controller configured to initiate the force imposing mechanism, game pieces, one or more surfaces providing paths to the launch pad from different locations external to the launch pad, and for each of the paths a mechanism movable to impart a force toward the launch pad, wherein the controller is configured to initiate the force imposing mechanism after the optical sensor detects a game piece in the payload bay.

7. The game of claim 6 in which the vehicle comprises a propeller driven airborne vehicle.

8. The game of claim 7 in which the game pieces are organized in sets and the game pieces of the different sets have different visible characteristics.

9. The game of claim 8 in which the one or more surfaces providing paths to the launch pad are pitched upward in the direction of the launch pad and are level in the direction normal to the direction of the launch pad.

10. The game of claim 6, wherein each game piece comprises:

a round body having a profile of a miniature alien, a top, and a bottom, a non-uniform weight distribution that is heavier nearer the bottom, and a ferrous ballast on the bottom.

11. The game of claim 10, wherein each game piece comprises external features that project from a surface of the game piece.

12. The game piece of claim 11, wherein the external features differ between game pieces.

13. The game of claim 6 in which the controller is configured to wait a predetermined time before initiating the force imposing mechanism.

14. The game of claim 13 in which the predetermined time is unchanging.

15. The game of claim 13 in which the predetermined time is dynamic.

16. The game of claim 15 in which the predetermined time is determined based on a number of game pieces in the payload bay.

17. The game of claim 6 in which the payload bay comprises a magnet.

* * * * *